US007710356B2

(12) United States Patent
Ikeda et al.

(10) Patent No.: US 7,710,356 B2
(45) Date of Patent: May 4, 2010

(54) PLASMA DISPLAY DEVICE

(75) Inventors: Satoshi Ikeda, Osaka (JP); Yoshinori Yamada, Osaka (JP); Katsumi Adachi, Nara (JP); Mikihiko Nishitani, Nara (JP); Masashi Goto, Osaka (JP)

(73) Assignee: Panasonic Corporation, Osaka (JP)

( * ) Notice: Subject to any disclaimer, the term of this patent is extended or adjusted under 35 U.S.C. 154(b) by 659 days.

(21) Appl. No.: 11/632,717

(22) PCT Filed: Jul. 5, 2005

(86) PCT No.: PCT/JP2005/012369

§ 371 (c)(1),
(2), (4) Date: Jan. 18, 2007

(87) PCT Pub. No.: WO2006/008954

PCT Pub. Date: Jan. 26, 2006

(65) Prior Publication Data

US 2008/0079664 A1 Apr. 3, 2008

(30) Foreign Application Priority Data

Jul. 21, 2004 (JP) ..... 2004-212712
Jul. 21, 2004 (JP) ..... 2004-212713

(51) Int. Cl.
*G09G 3/28* (2006.01)

(52) U.S. Cl. ..... 345/60; 345/66; 345/68

(58) Field of Classification Search ..... 345/37, 345/60–68; 349/32; 315/169.4
See application file for complete search history.

(56) References Cited

U.S. PATENT DOCUMENTS

| | | | |
|---|---|---|---|
| 5,745,085 | A | 4/1998 | Tomio et al. |
| 6,784,857 | B1 | 8/2004 | Nakamura |
| 2002/0175883 | A1 | 11/2002 | Onozawa et al. |
| 2004/0085305 | A1 | 5/2004 | Kunii et al. |

FOREIGN PATENT DOCUMENTS

| | | |
|---|---|---|
| EP | 1 416 465 | 5/2004 |
| JP | 7-219474 | 8/1995 |
| JP | 2000-206928 | 7/2000 |
| JP | 2002-351379 | 12/2002 |
| JP | 2004-93888 | 3/2004 |
| JP | 2004-138976 | 5/2004 |
| JP | 2005-10398 | 1/2005 |

OTHER PUBLICATIONS

Supplementary European Search Report issued Apr. 20, 2009 in the Application No. EP 05 75 8214.

*Primary Examiner*—Richard Hjerpe
*Assistant Examiner*—Mansour M Said
(74) *Attorney, Agent, or Firm*—Wenderoth, Lind & Ponack, L.L.P.

(57) ABSTRACT

A lighting rate is calculated from a video signal input in a plasma display device, and an output current of DC-DC converter, which is the same as a discharge current in a sustain period corresponding to the lighting rate, is synchronized with a generation timing of discharge current. With such a configuration, even if discharge current in the sustain period of each subfield is rapidly changed, a sustain pulse voltage can be kept constant.

2 Claims, 13 Drawing Sheets

PLASMA DISPLAY DEVICE

THIS APPLICATION IS A U.S. NATIONAL PHASE APPLICATION OF PCT INTERNATIONAL APPLICATION PCT/JP2005/012369.

BACKGROUND OF THE INVENTION

1. Field of Invention

The present invention relates to a plasma display device known as a thin and light display device having a large screen.

2. Description of the Related Art

Recently, large size image display devices such as a plasma display device have been popularized. Such a large size image display device can clearly display an image in detail. On the other hand, in such a device, image turbulence, which is caused by an unstable supply of voltage from a power supply, tends to be noticeable. In order to avoid such a problem, it is important for a power supply unit of the image display device to keep an output voltage constant.

A plasma display device displays an image by performing a discharge in a large number of discharge cells provided in a plasma display panel (hereinafter, abbreviated as "PDP"). A discharge current of a PDP at this time is much dependent upon a gradation value of an image to be displayed. When the gradation value is increased, the discharge current of the PDP is increased. On the contrary, the gradation value is reduced, the discharge current is reduced.

Japanese Patent Unexamined Publication No. 2002-351379 (hereinafter, referred to as "patent document 1") discloses an example of a power supply unit of a plasma display device in which an output voltage is made to be kept constant with respect to the above-mentioned change of a discharge current. This power supply unit detects a change of the output voltage generated when the discharge current is changed and carries out feedback control so that the output voltage becomes constant.

However, the power supply unit described in patent document 1 detects the change of the output voltage and thereafter carries out control for returning the voltage to the original voltage. Therefore, when the discharge current is significantly changed in a rapid manner, it is difficult to keep the output voltage constant.

BRIEF SUMMARY OF THE INVENTION

The present invention addresses the problems discussed above, and aims to provide a plasma display device for displaying an image with a correct gradation value in a state in which an output voltage is kept constant even when a discharge current of a PDP is rapidly changed.

In order to solve the foregoing problem, the present invention provides a plasma display device for displaying an image in a plasma display panel having a scanning electrode, a sustain electrode and a data electrode and provided with a plurality of discharge cells by configuring one field period by a plurality of subfields each having an initialization period, a writing period and a sustain period and by performing or not performing a discharge in the discharge cells in the sustain period based on a video signal. The plasma display device includes a sustain pulse voltage applying section for applying a sustain pulse voltage for allowing to discharge in the plurality of discharge cells to the scan electrode and the sustain electrode, a lighting rate calculation section for calculating a lighting rate showing a rate of discharge in the plurality of discharge cells in the sustain period from the video signal for each subfield in advance, a power supply section for supplying the sustain pulse voltage applying section with electric power, and a control section for controlling the power supply section based on the lighting rate so that the sustain pulse voltage becomes constant.

DETAILED DESCRIPTION OF THE INVENTION

Hereinafter, exemplary embodiments of the present invention are described with reference to drawings.

FIRST EXEMPLARY EMBODIMENT

Figure 1:
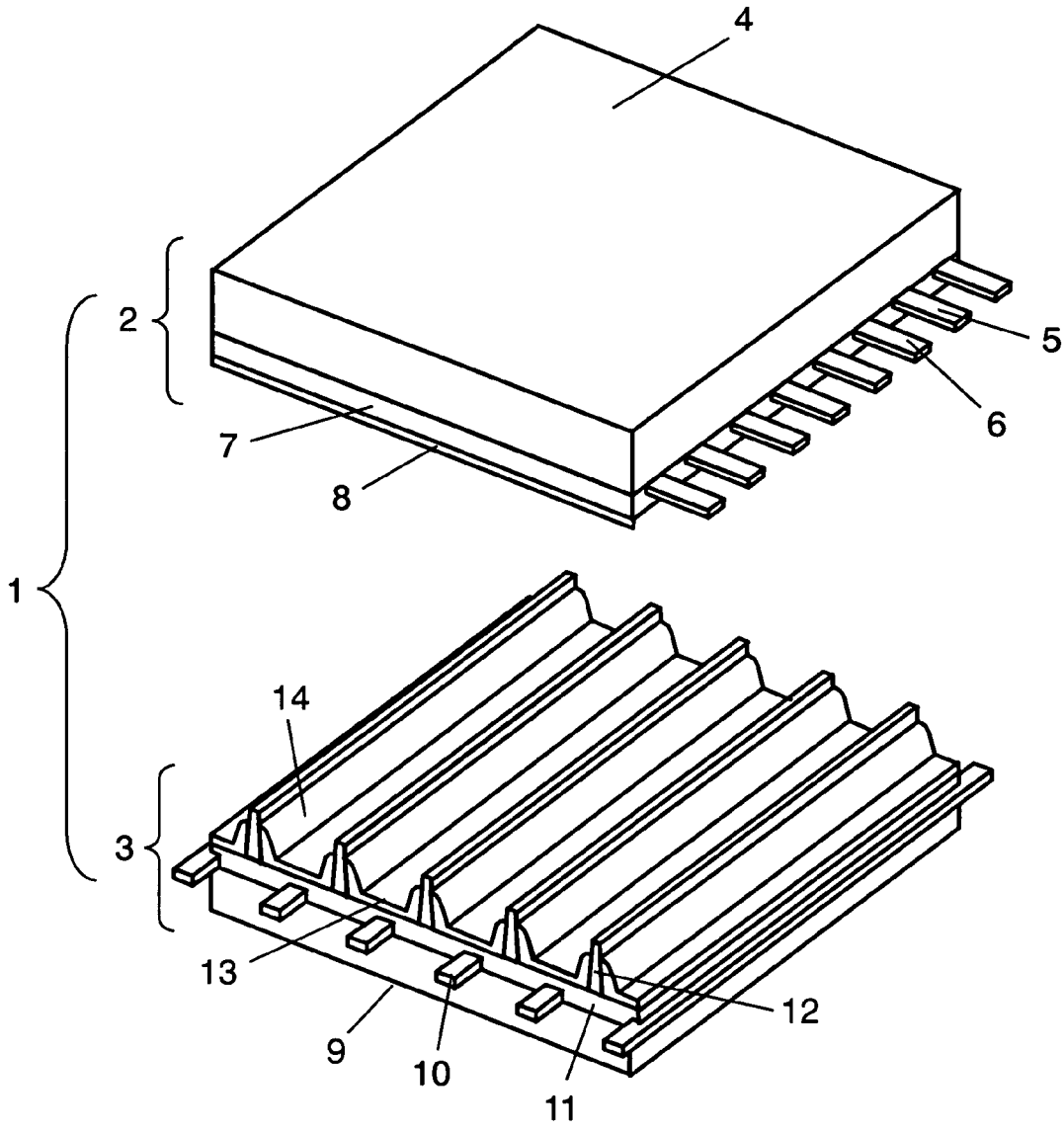
FIG. 1 is an exploded perspective view showing a structure of a PDP in accordance with a first exemplary embodiment of the present invention.

FIG. 1 is an exploded perspective view showing a structure of PDP 1 used in a plasma display device in accordance with a first exemplary embodiment of the present invention. PDP 1 includes front substrate 2 and rear substrate 3 disposed opposing each other. Seen from the side of front substrate 2, on front glass plate 4 of front substrate 2, plural pairs of scan electrode 5 and sustain electrode 6 are disposed in parallel to each other.

Dielectric layer 7 is formed so as to cover scan electrodes 5 and sustain electrodes 6. Protective layer 8 is formed so as to cover the surface of dielectric layer 7. On rear glass plate 9 of rear substrate 3, a plurality of data electrodes 10 are disposed in parallel to each other. Dielectric layer 11 is formed so as to cover data electrodes 10. On the surface of dielectric layer 11 and the side surface of barrier ribs 12, phosphor layer 13 is formed. Furthermore, in discharge space 14 surrounded by front substrate 2 and rear substrate 3, discharge gas is filled.

Figure 2:
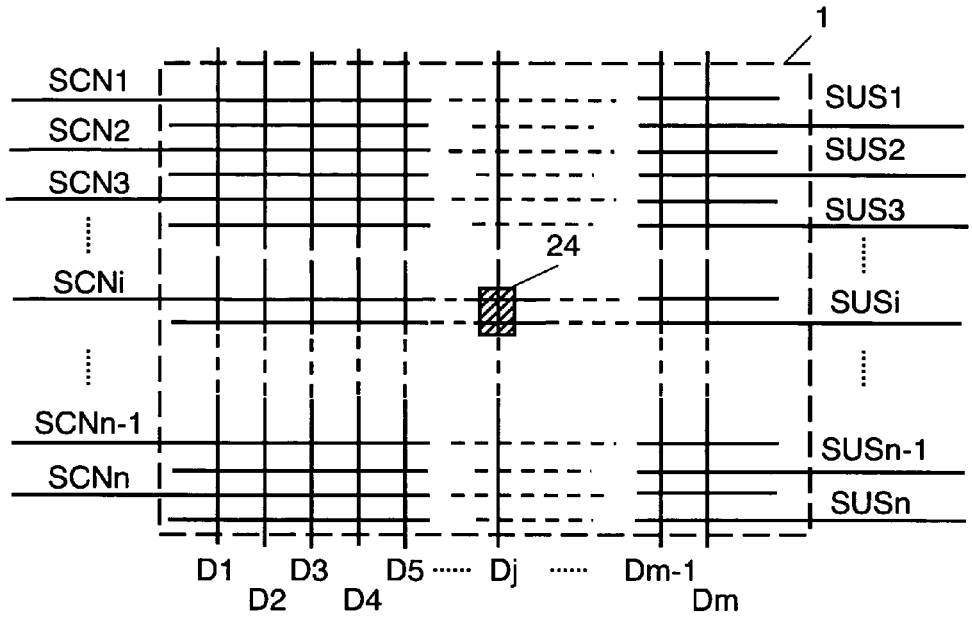
FIG. 2 is a diagram showing an arrangement of an electrode of a PDP used in a plasma display device in accordance with the first exemplary embodiment of the present invention.

FIG. 2 is a diagram showing an arrangement of an electrode of PDP 1 used in a plasma display device in accordance with the first exemplary embodiment of the present invention. M rows of data electrodes D1 to Dm (data electrodes 10 in FIG. 1) are disposed in a row direction, and n columns of scan electrodes SCN1 to SCNn (scan electrodes 5 in FIG. 1) and n columns of sustain electrodes SUS1 to SUSn (sustain electrodes 6 in FIG. 1) are alternatively disposed in a column direction. In a portion where a pair of scan electrode SCNi and sustain electrode SUSi (i=1 to n) three-dimensionally intersect with one data electrode Dj (j=1 to m), discharge cell 24 is formed. M×n pieces of discharge cells 24 are formed in discharge space.

As a method for driving PDP 1, a subfield method is employed. The subfield method includes dividing one field period into a plurality of subfields and displaying gradation by driving a combination of the subfields. Herein, each subfield has a weight showing the gradation of an image (hereinafter, referred to as "gradation weight").

Figure 3:
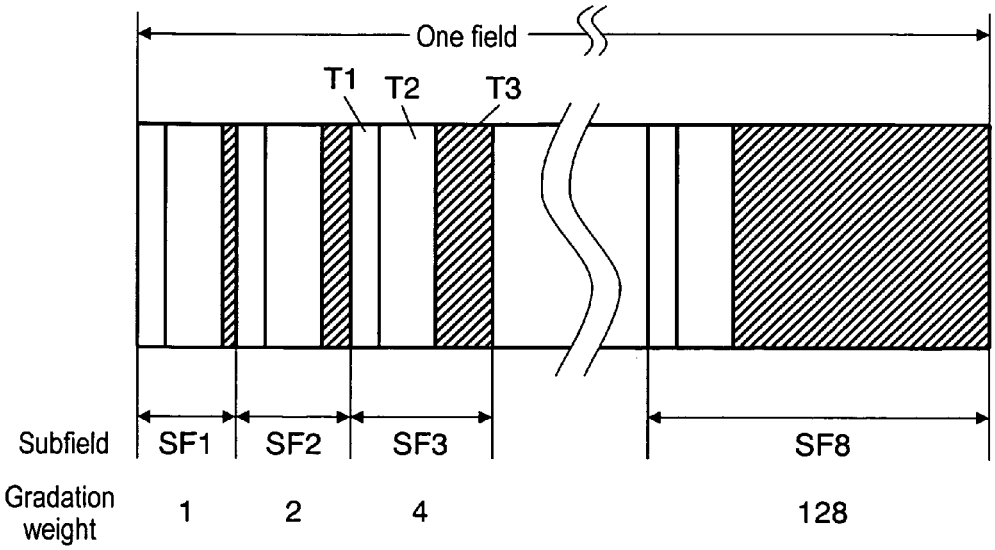
FIG. 3 is a diagram showing a configuration of subfields in one field of the plasma display device in accordance with the first exemplary embodiment of the present invention.

FIG. 3 is a view showing a configuration of subfields in one field in the plasma display device in accordance with the first exemplary embodiment of the present invention. In the first exemplary embodiment, one field period is divided into eight subfields (SF 1, SF 2, . . . and SF 8) and each subfield has gradation weight of 1, 2, 4, 8, 16, 32, 64, and 128, respectively. By combining the subfields variously and performing a discharge, 256 levels (from "0" to "255") of gradation values are displayed. For example, gradation value "7" is displayed by performing discharges in SF1, SF2 and SF3 having gradation weight 1, 2 and 4. Gradation value "21" is displayed by performing discharges in SF1, SF3 and SF5 having gradation weight 1, 4 and 16.

Each subfield includes initialization period T1 for performing an initialization discharge, writing period T2 for performing a writing discharge with respect to a discharge cell to be discharged, and sustain period T3 for performing a discharge simultaneously in the discharge cells written by the writing discharge.

Figure 4:
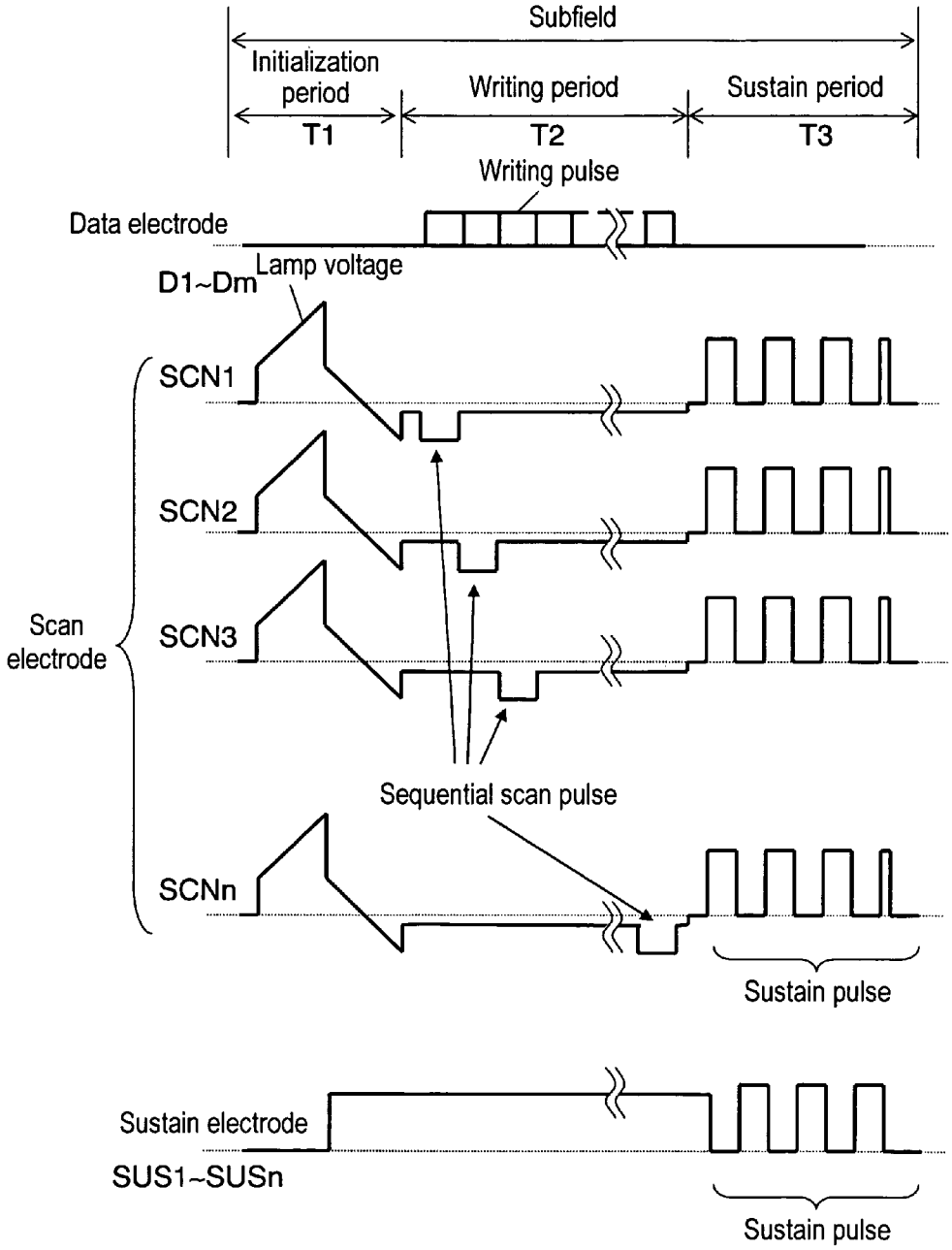
FIG. 4 is a diagram showing a drive waveform of a PDP in accordance with the first exemplary embodiment of the present invention.

FIG. 4 is a diagram showing a drive waveform of PDP 1 in accordance with the first exemplary embodiment of the present invention. In initialization period T1 of the subfield, a lamp voltage is applied to scan electrodes SCN1 to SCNn so as to cause an initialization discharge in all discharge cells at once, so that the history of previous wall charges with respect to the individual discharge cells is deleted and at the same time, a wall charge necessary for the following writing operation is formed. In writing period T2, a sequential scanning pulse is applied to scan electrodes SCN1 to SCNn, and a writing pulse corresponding to a video signal to be displayed is applied to data electrodes D1 to Dm. Then, a writing discharge is performed selectively between scan electrodes SCN1 to SCNn and data electrodes D1 to Dm. A wall charge is formed only in a discharge cell in which the writing discharge is performed. Furthermore, in sustain period T3, a sustain pulse is applied to a portion between scan electrodes SCN1 to SCNn and sustain electrodes SUS1 to SUSn a number of times that is in proportion to the gradation weight, and in only discharge cells, in which a wall charge has been formed in writing period T2, sustain discharge is performed. As to the other subfields, the same operation is performed.

Next, discharge current of PDP 1 is described. The initialization discharge in initialization period T1 is a weak discharge by a lamp voltage shown in FIG. 4. The discharge current thereof is smaller than that of the sustain discharge. Furthermore, in writing period T2, since writing discharge is sequentially generated for each scan electrode, a discharge current by writing discharge is smaller than that by sustain discharge in which discharge is performed on the entire screen. Therefore, a discharge current of PDP 1 is determined not by a discharge in the initialization period and the writing period, but rather by sustain discharge in the sustain period. Then, since the discharge current of the sustain discharge is a total of discharge current of each discharge cell, it is proportion to the rate of discharge cells discharging in the sustain period (hereinafter, referred to as "lighting rate").

Figure 5A:
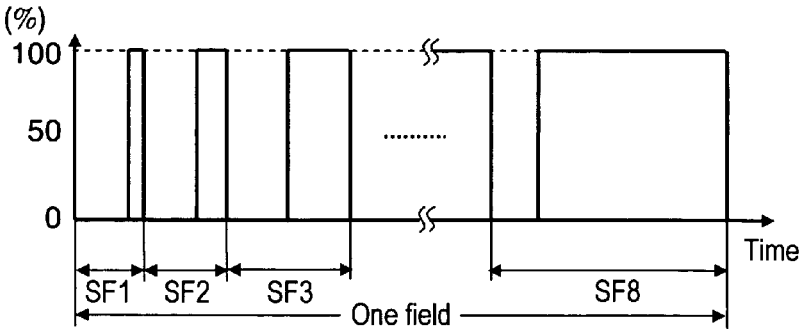
FIG. 5A shows a graph showing the change over time of a lighting rate in each subfield in one field.
Figure 5B:
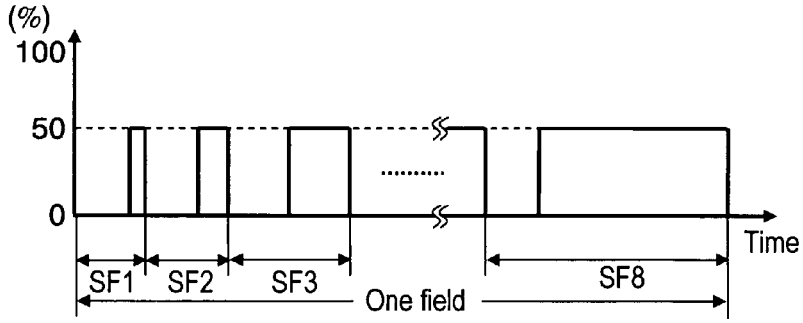
FIG. 5B shows a graph showing the change over time of a lighting rate in each subfield in one field.
Figure 5C:
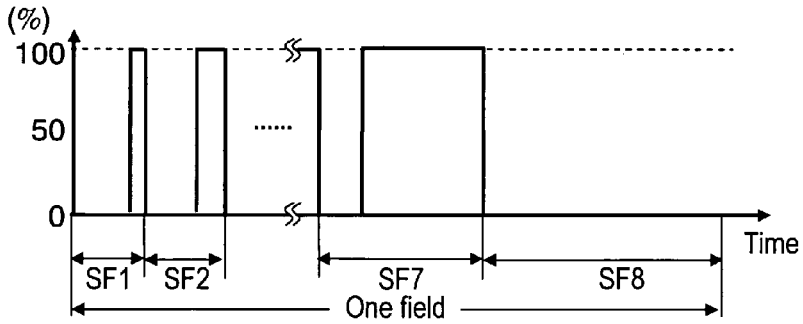
FIG. 5C shows a graph showing the change over time of a lighting rate in each subfield in one field.
Figure 5D:
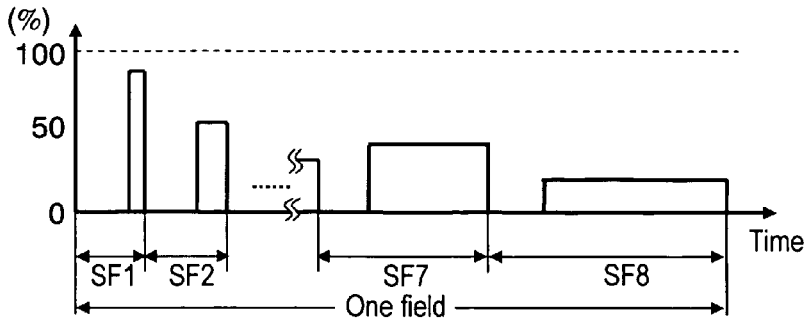
FIG. 5D shows a graph showing the change over time of a lighting rate in each subfield in one field.

FIGS. 5A to 5D are graphs respectively showing a change over time of a lighting rate in each subfield of one field. FIG. 5A shows a lighting rate when gradation value "255" is displayed in all discharge cells of PDP 1. In this case, since discharge is performed in all discharge cells in the sustain period of each subfield, the lighting rates of all the subfields become 100%. FIG. 5B shows a lighting rate when gradation value "255" is displayed in the half of the discharge cells and gradation value "0" is displayed in the rest of the discharge cells. In this case, discharge is not performed in the half of the discharge cells and discharge is performed in discharge cells in another half of the screen in the sustain period of each subfield. Therefore, the lighting rate in one field is 50% in all subfields. FIG. 5C shows a lighting rate when gradation value "127" is displayed in all discharge cells in PDP 1. In this case, since discharge is performed in all discharge cells in seven subfields (SF1 to SF7) each having gradation weight 1, 2, 4, 8, 16, 32 and 64, and discharge is not performed in all discharge cells in subfield SF 8 having gradation weight 128. Therefore, the lighting rates in SF1 to SF7 are 100% and the lighting rate of SF8 is 0%. FIG. 5D shows a lighting rate when a general image is displayed. In this case, a lighting rate of each subfield has various values in accordance with a gradation value of an image. However, the lighting rate of each subfield is constant in the sustain period of the subfield. Thus, the lighting rate in the sustain period of each subfield can be calculated from the number of discharge cells to be discharged. As mentioned above, when the lighting rate is known, a discharge current in the sustain period can be predicted.

Next, a means for supplying a discharge current is described.

Figure 6:
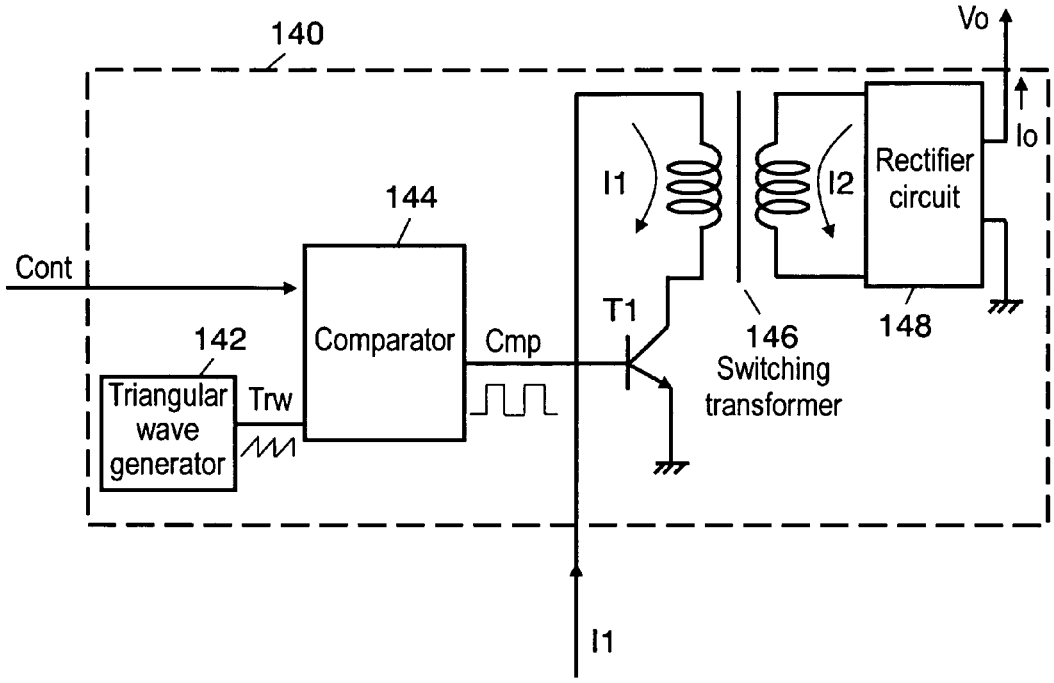
FIG. 6 is a circuit diagram showing a power supply section of the plasma display device in the first exemplary embodiment of the present invention.

FIG. 6 is a circuit diagram showing a power supply section for supplying discharge current of the plasma display device in the first exemplary embodiment of the present invention. In the first exemplary embodiment, as a power supply means, DC-DC converter 140 capable of controlling power supply ability by first current control signal Cont is used.

In FIG. 6, triangular wave generator 142 generates triangular wave voltage Trw whose cycle and DC offset are constant. Comparator 144 compares a voltage of first current control signal Cont with triangular wave voltage Trw and generates PWM (PULSE WIDTH MODULATION) signal Cmp. Comparator 144 outputs "H" signal when the voltage of first current control signal Cont is higher than triangular wave voltage Trw, and generates "L" signal when the voltage of signal Cont is lower than voltage Trw. By repeating "H," signal and "L" signal alternately, PWM signal Cmp is generated. Therefore, when the voltage of first current control signal Cont is increased, the duty ratio of PWM signal Cmp can be increased. On the contrary, when the voltage of first current control signal Cont is reduced, the duty ratio can be reduced.

PWM signal Cmp is input to the base of switching transistor T1 so as to control primary side current I1 of switching transformer 146. When PWM signal Cmp is "H" signal, primary side current I1 flows. When the signal is "L" signal, primary side current I1 is blocked. Therefore, as the duty ratio of PWM signal Cmp is larger, primary side current I1 flowing per unit time is increased and secondary side current I2 generated via switching transformer 146 is also increased in proportion to primary side current I1. Secondary side current I2 is rectified by rectifier circuit 148 and supplied to the below-mentioned sustain pulse voltage applying circuits 172 and 182. In this way, power supply ability of DC-DC converter 140 is controlled by first current control signal Cont.

Figure 7A:
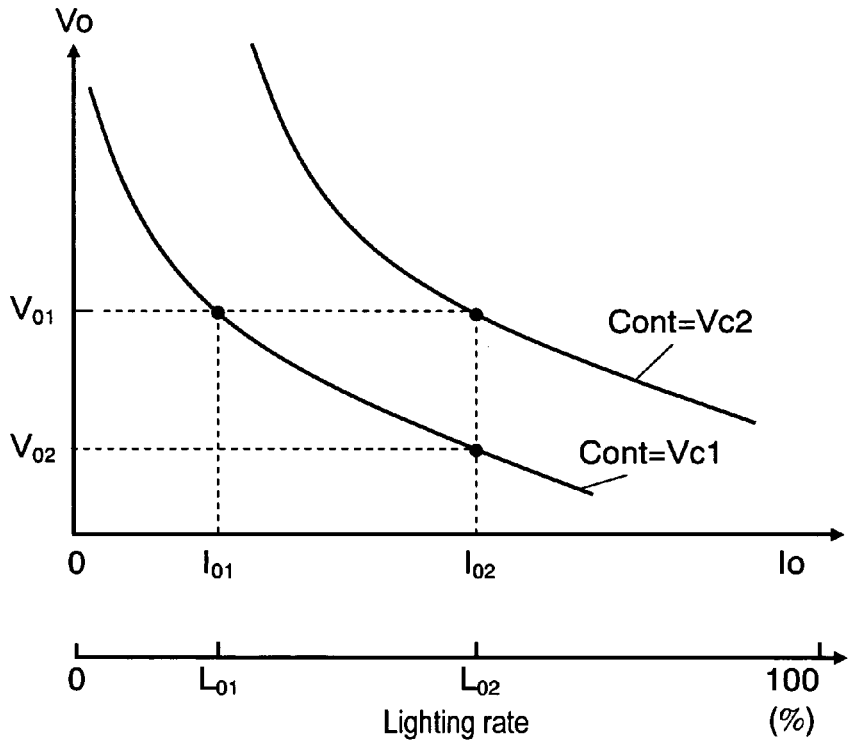
FIG. 7A is a graph showing a relation between the lighting rate and both output current and output voltage of a DC-DC converter when a current control signal is employed as a parameter.

FIG. 7A is a characteristic curve showing the relation between the lighting rate and both output current Io and output voltage Vo of DC-DC converter 140 when a current control signal is employed as a parameter. In FIG. 7A, abscissa shows output current Io and the lighting rate, and ordinate shows output voltage Vo.

In DC-DC converter 140, when first current control signal Cont is set to Vc1 (V) and output current Io is set to $I_{01}$ (A), output voltage Vo becomes $V_{01}$ (V). When output current Io is increased to $I_{02}$ (A) in a state in which first current control signal Cont is kept at Vc1, the output voltage is reduced from voltage $V_{01}$ (V) to voltage $V_{02}$ (V). However, if it has been known in advance that output current Io is increased from $I_{01}$ (A) to $I_{02}$ (A), by increasing first current control signal Cont from voltage Vc1 (V) to Vc2 (V) at the same time when output current Io is changed, output voltage Vo can be kept constant at $V_{01}$ (V). Thus, by controlling first current control signal Cont in accordance with the change of output current Io, output voltage Vo of DC-DC converter 140 can be kept constant.

Herein, output current Io is equal to a discharge current except for electric power consumed in the drive circuit. Furthermore, as mentioned above, the discharge current is in proportion to the lighting rate. Therefore, by controlling first current control signal Cont in accordance with the change of the lighting rate, output voltage Vo of DC-DC converter 140 can be kept constant.

Figure 7B:
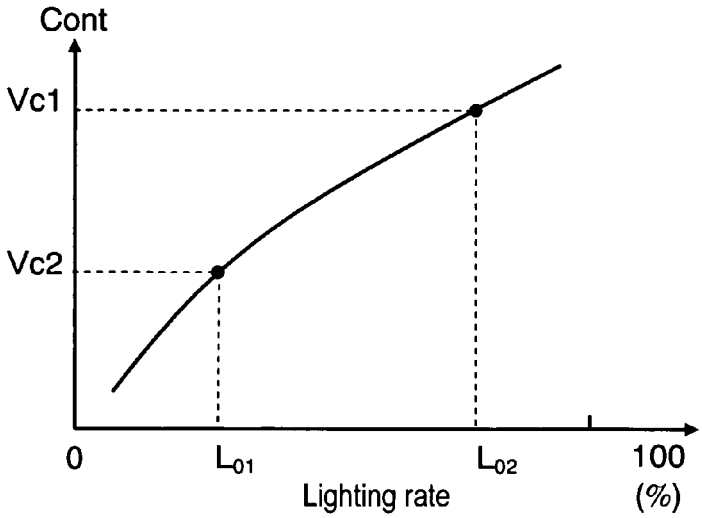
FIG. 7B is a graph showing a relation between the lighting rate and a current control signal in order to keep the output voltage of the DC-DC converter constant.

FIG. 7B is a graph showing the relation between the lighting rate and first current control signal Cont. The voltage of first current control signal Cont is shown in ordinate based on FIG. 7A. As mentioned above, since the lighting rate of the video signal can be calculated in advance, when the relation shown in FIG. 7B is stored in a storage portion, by inputting first current control signal Cont into DC-DC converter 140 in accordance with the lighting rate, output voltage Vo can be kept constant.

Thus, the first exemplary embodiment of the present invention uses feedforward control in which the lighting rate is calculated in advance, so that discharge current is predicted and output voltage Vo is kept constant. In the feedforward control, since output voltage Vo does not depend upon the present discharge current, advanced control can be performed.

Note here that these characteristic curves are obtained by actually supplying electric power from DC-DC converter 140 to the plasma display device of the present invention, and actually measuring the relation between the lighting rate and output voltage Vo by using first current control signal Cont as a parameter. Furthermore, with such feedforward control, since the same amount of current as current Ic2 flowing into rectifier circuit 148 flows simultaneously as output current Io, the capacity of a capacitor to be used in rectifier circuit 148 can be reduced.

Next, the circuit configuration of the plasma display device is described.

Figure 8:
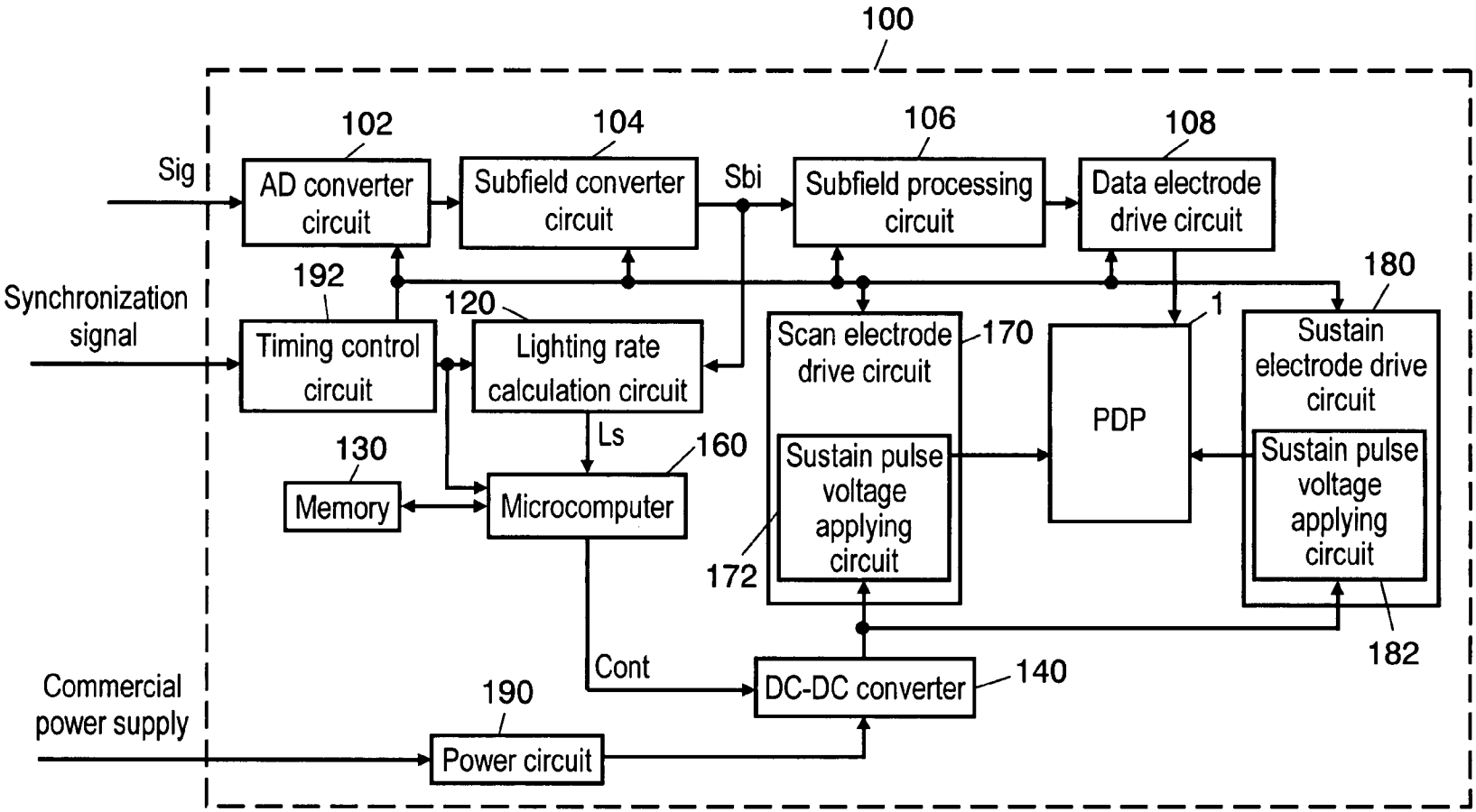
FIG. 8 is a circuit block diagram showing a plasma display device in accordance with the first exemplary embodiment of the present invention.

FIG. 8 is a circuit block diagram showing plasma display device 100 in accordance with the first exemplary embodiment of the present invention. Input video signal Sig is analog-to-digital converted in AD converter circuit 102 and further, subfield converted in subfield converter circuit 104, so that eight bit digital subfield signal Sbi (i=1 to 8) is obtained. Then, the image is displayed on PDP 1 via subfield processing circuit 106 and data electrode drive circuit 108. Furthermore, lighting rate calculation circuit 120 that is a lighting rate calculation section calculates lighting rate Li of each subfield based on digital subfield signal Sbi so as to generate lighting rate signal Ls.

Herein, digital subfield signal Sbi is a signal showing whether discharge is performed or not performed in each discharge cell in the sustain period of the i-th subfield. In the first exemplary embodiment of the present invention, digital subfield signal Sb1 at the first bit has a value "1" with respect to a discharge cell in which discharge is performed in the sustain period of the first subfield (SF1) and a value "0" with respect to a discharge cell in which discharge is not performed. The same is true in digital subfield signals Sb 2 to Sb 8. Therefore, lighting rate calculation circuit 120 calculates the total number of "1" of each digital subfield signal Sbi and divides the calculated total number by the number of the entire discharge cells so as to obtain lighting rate Li. The obtained value is output while it is synchronized with the sustain period of each subfield, thus generating lighting rate signal Ls.

Memory 130 stores the relation between lighting rate L and first current control signal Cont for keeping output voltage Vo of DC-DC converter 140 constant as a look-up table (hereinafter, referred to as "LUT"). Microcomputer 160 reads out first current control signal Cont based on lighting rate signal Ls with reference to LUT of memory 130, and outputs control signal Cont to DC-DC converter 140. DC-DC converter 140 supplies electric power to sustain pulse voltage applying circuits 172 and 182 that are sustain pulse voltage applying sections provided in scan electrode drive circuit 170 and sustain electrode drive circuit 180 based on first current control signal Cont. Sustain pulse voltage applying circuits 172 and 182 apply sustain pulse voltage that is equal to output voltage Vo to scan electrodes SCN1 to SCNn and sustain electrodes SUS1 to SUSn.

Power circuit 190 converts an alternating voltage of the commercial power supply into a direct voltage and supplies DC-DC converter 140 with electric power. Furthermore, to each circuit block other than sustain pulse voltage applying circuits 172 and 182, necessary electric power is supplied from a power circuit (not shown). Furthermore, timing control circuit 192 generates necessary timing control signals based on the synchronization signal and supplies the generated signal to each signal block.

Next, an operation of the plasma display device is described. FIGS. 9A to 9F show an output signal in each circuit block of the plasma display device in accordance with the first exemplary embodiment of the present invention. The first exemplary embodiment describes the case where an image is displayed on PDP 1 delaying by only one field period with respect to video signal Sig of the precedent field.

Figure 9A:
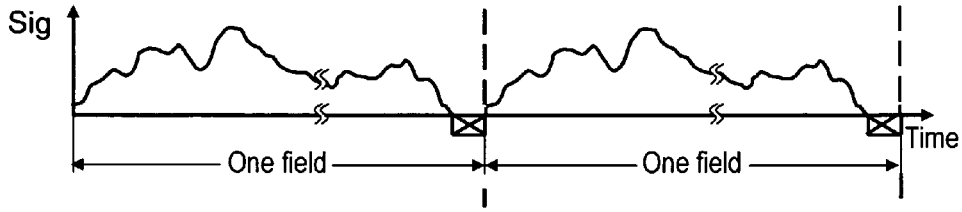
FIG. 9A is a graph showing an output signal of each circuit block of the plasma display device in accordance with the first exemplary embodiment of the present invention.
Figure 9B:
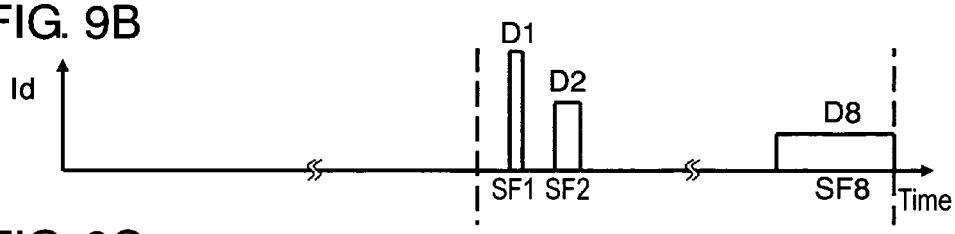
FIG. 9B is a graph showing an output signal of each circuit block of the plasma display device in accordance with the first exemplary embodiment of the present invention.

FIG. 9A shows video signal Sig input to the plasma display device. FIG. 9B shows discharge current Id of PDP 1 with respect to video signal Sig. Discharge current Id corresponds to video signal Sig of one precedent field. The size of discharge current Id in the sustain period of the first subfield is defined as D1. The same is true in D2 to D8.

Figure 9C:
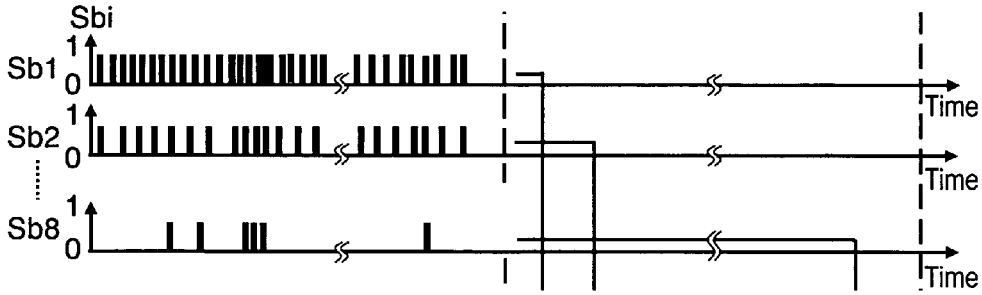
FIG. 9C is a graph showing an output signal of each circuit block of the plasma display device in accordance with the first exemplary embodiment of the present invention.
Figure 9D:
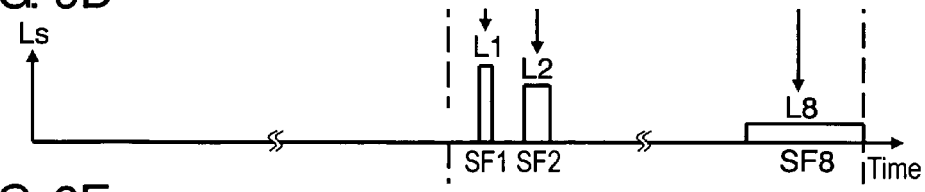
FIG. 9D is a graph showing an output signal of each circuit block of the plasma display device in accordance with the first exemplary embodiment of the present invention.
Figure 9E:
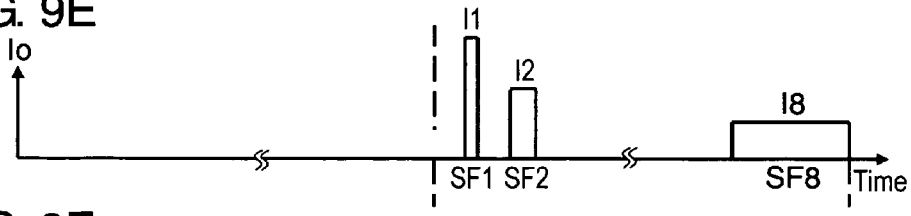
FIG. 9E is a graph showing an output signal of each circuit block of the plasma display device in accordance with the first exemplary embodiment of the present invention.

FIG. 9C shows eight digital subfield signals Sbi output from subfield converter circuit 106. As mentioned above, by dividing the total number of "1" of each digital subfield signal Sbi by the number of the entire discharge cells, lighting rate Li in the sustain period of the i-th subfield is obtained. FIG. 9D shows lighting rate signal Ls output from digital subfield signal Sbi. Lighting rate signal Ls outputs lighting rate "0" in the initialization period and the writing period of the first subfield and outputs lighting rate Li in the sustain period. Similarly, in the second subfield or later, lighting rate "0" is output in the initialization period and the writing period, and lighting rates L2 to L8 are output in the sustain period. FIG. 9E shows output current Io of DC-DC converter 140.

Figure 9F:
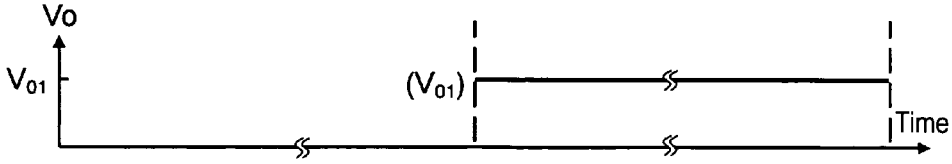
FIG. 9F is a graph showing an output signal of each circuit block of the plasma display device in accordance with the first exemplary embodiment of the present invention.

Herein, discharge current Di of PDP 1 is predicted from lighting rate Li, and the value and discharge timing have been known in advance. Therefore, the value of output current Io of DC-DC converter 140 is "0" in the initialization period and the writing period of each subfield and is adjusted to be equal to discharge current Di predicted from lighting rate Li in the sustain period. That is to say, in FIGS. 9B and 9E, output current I1 in the sustain period of the first subfield has the same value as that of discharge current D1 of PDP 1. Output currents I2 to I8 of the second subfield or later also have the same values as those of discharge currents D2 to D8. Furthermore, output currents I1 to I8 are output only in the sustain period of each subfield and the timing thereof is synchronized with the timing at which each of discharge currents D1 to D8 is generated in the sustain period. Therefore, as shown in FIG. 9F, it is possible to keep output voltage Vo of DC-DC converter 140 constant.

The first exemplary embodiment describes the case where discharge current Id is generated delaying by one field period with respect to input video signal Sig. However, when this delaying time is two fields, by delaying lighting rate signal Ls by two fields, the present invention can be applied. The same is true in the case where discharge delays by three fields or more with respect to video signal Sig.

As mentioned above, lighting rate Li of each field is calculated in advance and output voltage Vo of the DC-DC converter can be controlled so as to be kept constant in accordance with this lighting rate Li.

SECOND EXEMPLARY EMBODIMENT

Figure 10:
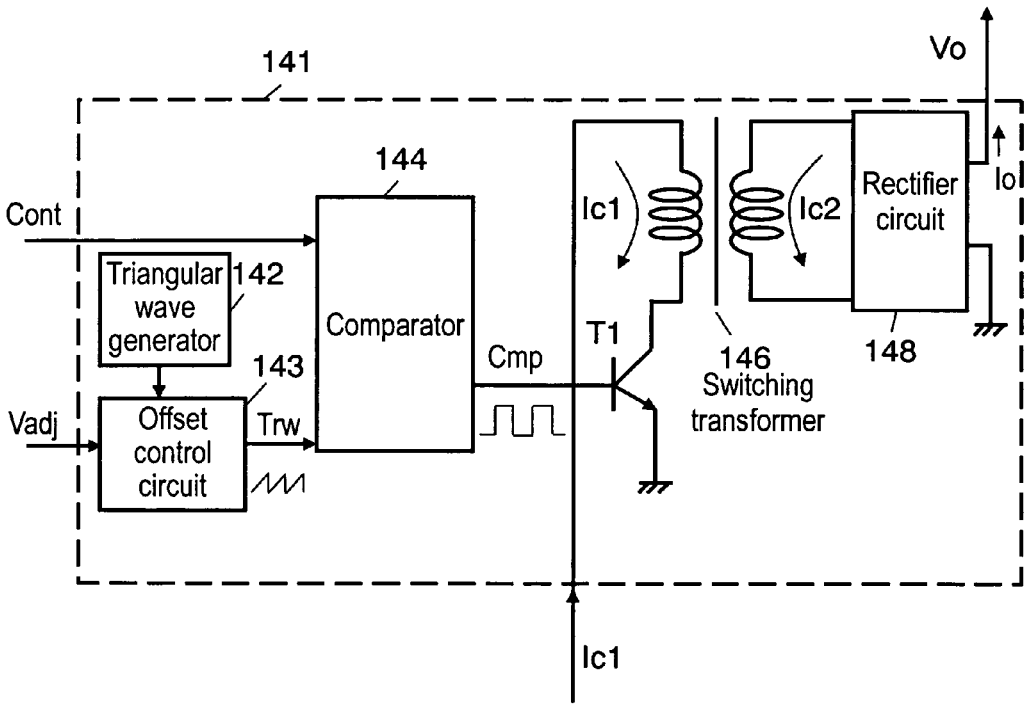
FIG. 10 is a circuit diagram showing a power supply section of a plasma display device in accordance with a second exemplary embodiment of the present invention.

FIG. 10 is a circuit diagram showing a power supply section for supplying a discharge current in a plasma display device in accordance with a second exemplary embodiment of the present invention. As a power supply means, the second exemplary embodiment uses DC-DC converter 141 capable of controlling an amount of power supply by first current control signal Cont and second current control signal Vadj.

In FIG. 10, triangular wave generator 142 generates a triangular wave voltage whose cycle is constant. The generated triangular wave voltage becomes triangular wave voltage Trw in which offset was set by offset control circuit 143 and is input to comparator 144. The offset value of triangular wave voltage Trw is determined by second current control signal Vadj. Then, comparator 144 compares the voltage of first current control signal Cont with triangular wave voltage Trw and outputs PWM (PULSE WIDTH MODULATION) signal Cmp.

When the voltage of Vadj is constant, both cycle and offset of triangular wave voltage Trw are constant. The duty ratio of PWM signal Cmp generated from comparator 144 is dependent only on first current control signal Cont. This state corresponds to an operation state of DC-DC converter 140 used in the plasma display device shown in FIG. 6 in the first exemplary embodiment of the present invention. That is to say, a rapid change of a discharge current of PDP can be feedforward controlled so that output voltage Vo of DC-DC converter 140 becomes constant.

However, actually, due to unpredictable change such as the change of commercial power supply, output voltage Vo may be changed. In addition to this, a factor for changing output voltage Vo may include variation of components to be used in the plasma display device. Variation of components to be used may cause inconsistency between output current Io set by only feedforward control and an actual discharge current. In production, since mass production should be performed by sufficiently considering variation of components, it is important to reduce the effect of variation.

With the plasma display device in accordance with the second exemplary embodiment of the present invention, second current control signal Vadj is feedback controlled so as to compensate the above-mentioned feedforward control and to suppress the change of output voltage Vo.

Hereinafter, an operation of second current control signal Vadj is described. Current control signal Vadj is generated by comparing the value of output voltage Vo of DC-DC converter 141 with the value of a reference voltage. The value of the reference voltage is a target value of output voltage Vo.

Figure 11A:
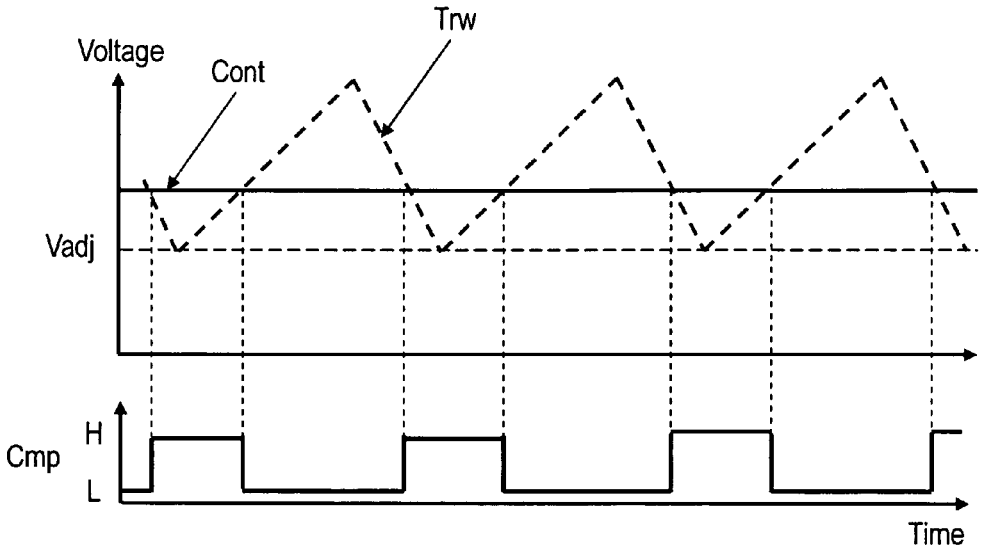
FIG. 11A is a graph showing a relation of second current control signal Vadj with respect to triangular wave voltage Trw and PWM signal Cmp.
Figure 11B:
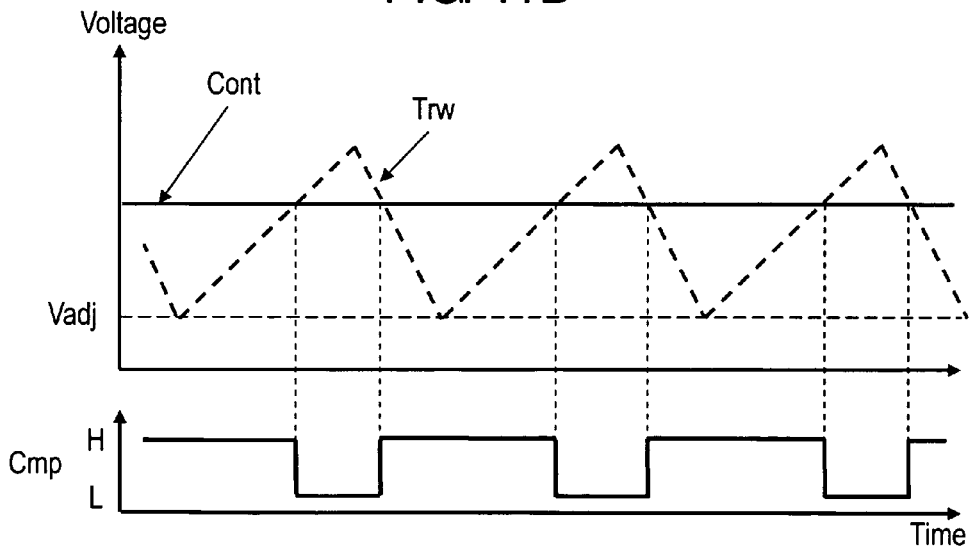
FIG. 11B is a graph showing a relation of second current control signal Vadj with respect to triangular wave voltage Trw and PWM signal Cmp.

FIGS. 11A and 11B are graphs showing a relation of second current control signal Vadj with respect to triangular wave voltage Trw and PWM signal Cmp. FIG. 11A shows the case where output voltage Vo is higher than the reference voltage. At this time, the voltage value of second current control signal Vadj is increased and offset of triangular wave voltage Trw in offset control circuit 143 is increased. Therefore, since the duty ratio of PWM signal Cmp is reduced and output current Io of DC-DC converter 141 is reduced, output voltage Vo is reduced and approaches the reference voltage. Furthermore, FIG. 11B shows the case where output voltage Vo is lower than the reference voltage. The voltage value of second current control signal Vadj drops and offset of triangular wave voltage Trw is reduced. Therefore, since the duty ratio of PWM signal Cmp is increased and output current Io of DC-DC converter 141 is increased, output voltage Vo is increased and approaches the reference voltage.

Thus, the plasma display device in accordance with the second exemplary embodiment of the present invention can suppress the change of output voltage Vo by feedback control so as to be returned to the reference voltage even when unpredictable change generated by, for example, commercial power supply occurs. Furthermore, even when variation occurs in components to be used in the plasma display device, the change of output voltage Vo generated by this variation is detected and output current Io is feedback controlled by second current control signal Vadj. Thus, it is possible to suppress the unpredictable change of output voltage Vo.

In FIGS. 11A and 11B, second current control signal Vadj controls the offset of the triangular wave. However, a configuration in which first current control signal Cont controls the offset of the triangular wave or a configuration in which both first and second electric control signals control the offset of the triangular wave may be employed. Furthermore, when output voltage Vo is high value and cannot be directly compared with the reference voltage, comparison may be performed after output voltage Vo is divided.

Figure 12:
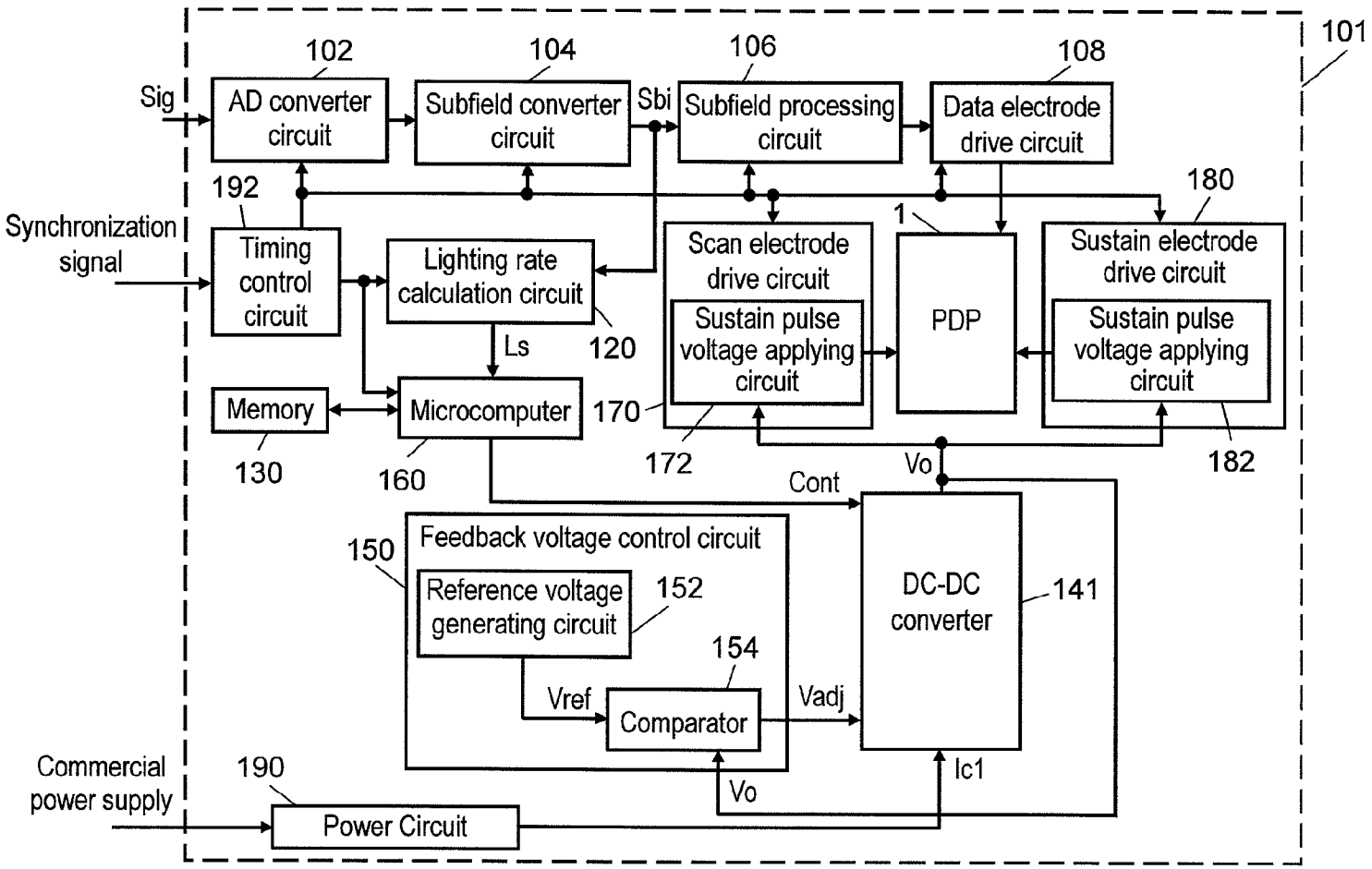
FIG. 12 is a circuit block diagram of the plasma display device in accordance with the second exemplary embodiment of the present invention.

Next, the circuit configuration of the plasma display device is described. FIG. 12 is a circuit block diagram showing plasma display device 101 in accordance with the second exemplary embodiment of the present invention.

Plasma display device 101 is different from plasma display device 100 in accordance with the first exemplary embodiment of the present invention in that feedback voltage control circuit 150 is introduced so as to control DC-DC converter 141 not only by first current control signal Cont but also by second current control signal Vadj.

Feedback voltage control circuit 150 detects difference between present output voltage Vo of DC-DC converter 141 and reference voltage Vref output from reference voltage generating circuit 152 by using comparator 154. Then, in accordance with this difference, second current control signal Vadj is generated and the generated signal is output to DC-DC converter 141. Output voltage Vo is equal to a sustain pulse voltage and output current Io of DC-DC converter 141 is controlled based on the sustain pulse voltage.

DC-DC converter 141 supplies electric power to sustain pulse voltage applying circuits 172 and 182 provided in scan electrode drive circuit 170 and sustain electrode drive circuit 180 based on first current control signal Cont and second current control signal Vadj. Sustain pulse voltage applying circuits 172 and 182 apply a sustain pulse voltage that is equal to output voltage Vo to scan electrodes SCN1 to SCNn and sustain electrodes SUS1 to SUSn.

Power circuit 190 converts an alternating voltage of the commercial power supply into a direct voltage and supplies DC-DC converter 140 with electric power. Furthermore, to each circuit block other than sustain pulse voltage applying circuits 172 and 182, necessary electric power is supplied from a power circuit (not shown). Furthermore, timing control circuit 192 generates necessary timing control signals based on the synchronization signal and supplies the generated signal to each signal block.

Next, an operation of the plasma display device is described. FIGS. 13A to 13F show an output signal in each circuit block of the plasma display device in accordance with the second exemplary embodiment of the present invention. Similar to the above-mentioned first exemplary embodiment, in this description of this exemplary embodiment, an image displayed on PDP 1 is displayed as an image delaying by only one field period with respect to video signal Sig of the precedent field.

Figure 13A:
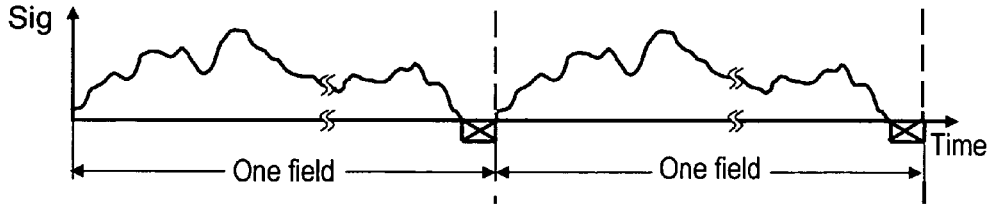
FIG. 13A is a graph showing an output signal of each circuit block of the plasma display device in accordance with the second exemplary embodiment of the present invention.
Figure 13B:
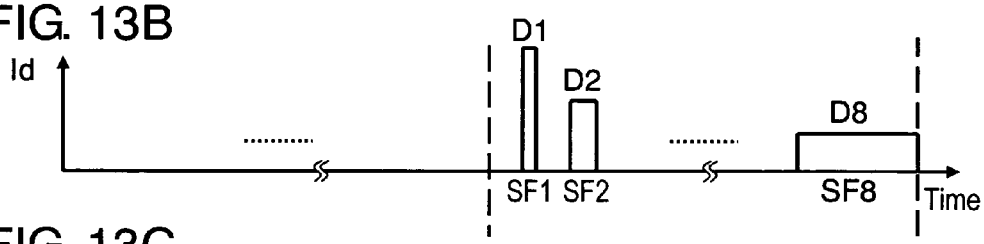
FIG. 13B is a graph showing an output signal of each circuit block of the plasma display device in accordance with the second exemplary embodiment of the present invention.
Figure 13C:
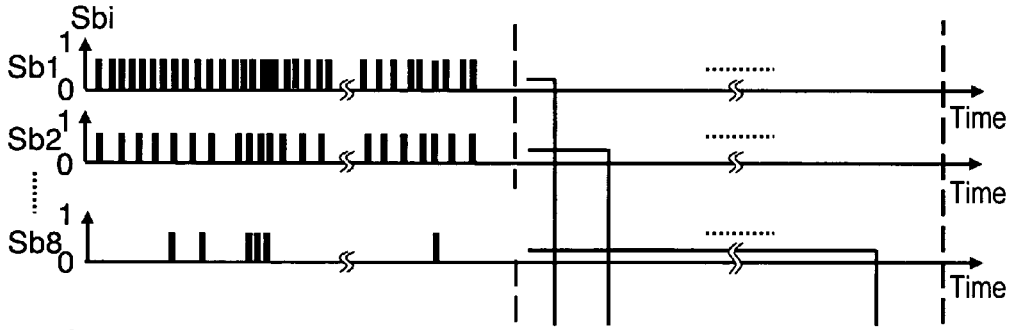
FIG. 13C is a graph showing an output signal of each circuit block of the plasma display device in accordance with the second exemplary embodiment of the present invention.
Figure 13D:
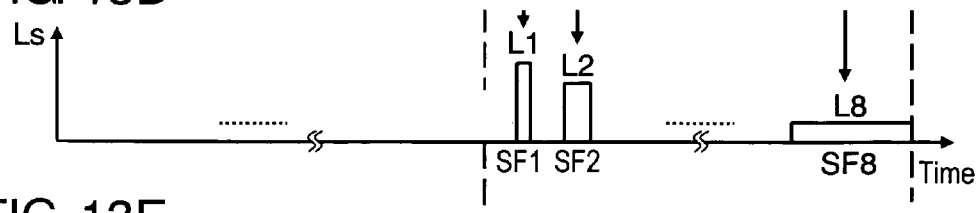
FIG. 13D is a graph showing an output signal of each circuit block of the plasma display device in accordance with the second exemplary embodiment of the present invention.
Figure 13E:
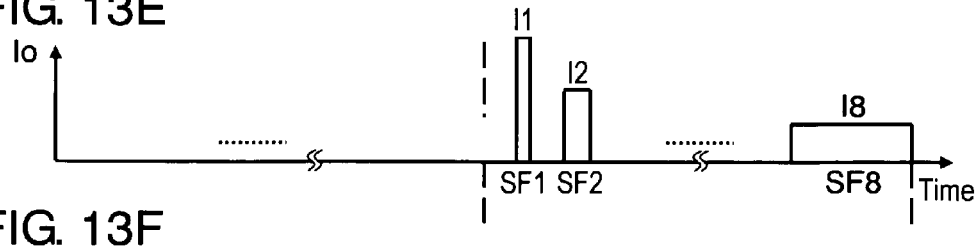
FIG. 13E is a graph showing an output signal of each circuit block of the plasma display device in accordance with the second exemplary embodiment of the present invention.
Figure 13F:
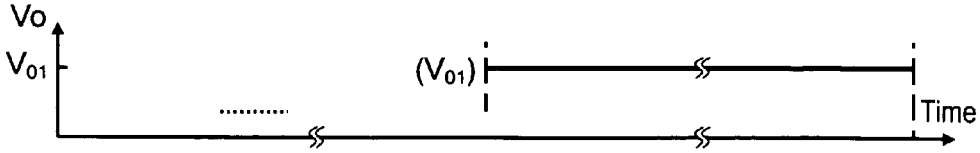
FIG. 13F is a graph showing an output signal of each circuit block of the plasma display device in accordance with the second exemplary embodiment of the present invention.

FIG. 13A shows video signal Sig input to the plasma display device. FIG. 13B shows discharge current Id of PDP 1 with respect to video signal Sig. Discharge current Id corresponds to video signal Sig of one precedent field. The size of discharge current Id in sustain period T3 of the first subfield is defined as D1. The same is true in D2 to D8. FIG. 13C shows eight digital subfield signals Sbi output from subfield converter circuit 104. As mentioned above, by dividing the total number of "1" of each digital subfield signal Sbi by the number of the entire discharge cells, lighting rate Li in the sustain period of the i-th subfield is obtained. FIG. 13D shows lighting rate signal Ls obtained from digital subfield signal Sbi. Lighting rate signal Ls outputs lighting rate "0" in initialization period T1 and writing period T2 of the first subfield and outputs lighting rate L1 in sustain period T3. Similarly, in the second subfield or later, lighting rate "0" is output in initialization period T1 and writing period T2, lighting rate "0," and lighting rates L2 to L8 are output in sustain period T3. FIG. 13E shows output current Io of DC-DC converter 140. FIG. 13F shows output voltage Vo of DC-DC converter 140.

Herein, discharge current Di of PDP 1 is predicted from lighting rate Li, and the value and discharge timing have been known in advance. Therefore, the value of output current Io of DC-DC converter 140 is "0" in initialization period T1 and writing period T2 of each subfield and can be adjusted to be equal to discharge current Di predicted from lighting rate Li in sustain period T3. That is to say, in FIGS. 13B and 13E, the value of output current I1 in sustain period T3 of the first subfield is the same as that of discharge current D1 of PDP 1. The values of output currents I2 to I8 of the second subfield or later are the same values as those of discharge currents D2 to D8. Furthermore, output currents I1 to I8 are output only in sustain period T3 of each subfield and the timing thereof is synchronized with the timing at which each of discharge currents D1 to D8 is generated in sustain period T3. With such feedforward control, as shown in FIG. 13F, it is possible to keep output voltage Vo of DC-DC converter 140 constant.

FIGS. 14A to 14D show the relation of the change over time of primary side current Ic1 with respect to second current control signal Vadj, and output current Io and output voltage Vo of DC-DC converter 141.

Figure 14A:
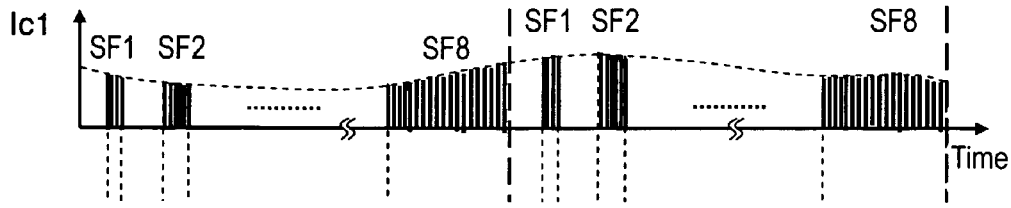
FIG. 14A is a graph showing a relation of the change over time of a primary side current with respect to a second current control signal, and output current and output voltage of a DC-DC converter.

FIG. 14A shows the change over time of primary side current Ic1. A gentle change shown by a broken line in FIG. 14A shows a change of primary side current Ic1 supplied from power circuit 190. For example, a cycle, in which a commercial power supply is changed and primary side current Ic1 changes irregularly, is extremely longer than a cycle of output current Io that rapidly changes corresponding to a discharge current generated for each sustain period T3 of the sub-field and can be sufficiently followed by a feedback control. For convenience of description, the cycle of primary side current Ic1 shown in the drawing is shorter than the actual cycle. Furthermore, intense change of primary side current Ic1 in sustain period T3 of each subfield (SF1, SF2, . . . , SF8) shows the repetition of conduction and block of primary side current Ic1 for generating output current Io.

Figure 14B:
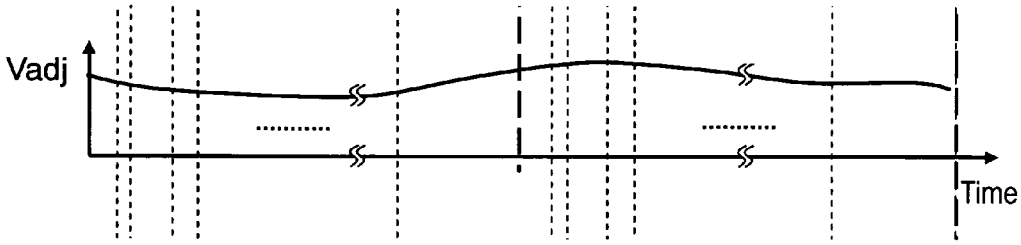
FIG. 14B is a graph showing a relation of the change over time of a primary side current with respect to a second current control signal, and output current and output voltage of a DC-DC converter.

FIG. 14B shows second current control signal Vadj changing corresponding to primary side current Ic1. With respect to the change in which the cycle of primary side current Ic1 is long, second current control signal Vadj acts in the direction in which the change is cancelled.

Figure 14C:
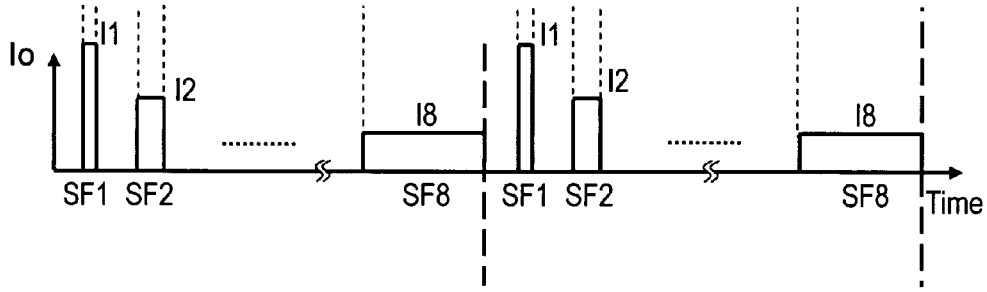
FIG. 14C is a graph showing a relation of the change over time of a primary side current with respect to a second current control signal, and output current and output voltage of a DC-DC converter.
Figure 14D:
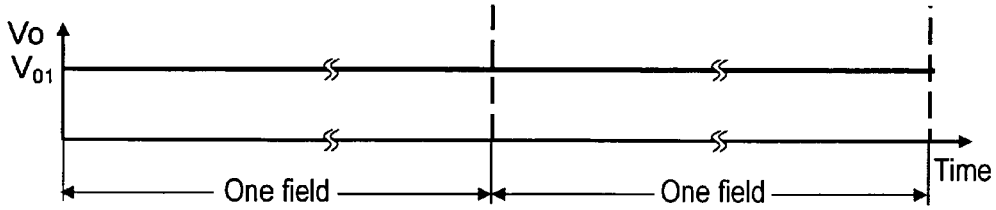
FIG. 14D is a graph showing a relation of the change over time of a primary side current with respect to a second current control signal, and output current and output voltage of a DC-DC converter.

As shown in FIG. 11A, when primary side current Ic1 is increased, output current Io is increased and output voltage Vo is increased. Since feedback voltage control circuit 150 detects that this output voltage Vo is increased, and accordingly increases the voltage of second current control signal Vadj, the duty ratio of DC-DC converter 141 is reduced. As a result, it is possible to keep output voltage Vo constant by suppressing the increase of output current Io. Furthermore, as shown in FIG. 11B, when primary side current Ic1 is reduced, output current Io is reduced and output voltage Vo becomes low. Since feedback voltage control circuit 150 detects that output voltage Vo becomes low and accordingly reduces the voltage of second current control signal Vadj, the duty ratio is increased. Therefore, it is possible to keep output voltage Vo constant by suppressing the reduction of output current Io. FIGS. 14C and 14D show output current Io and output voltage Vo of DC-DC converter 141.

The first exemplary embodiment describes occurrence of discharge current Id delaying by one field with respect to input video signal Sig. When this delaying time is two fields, by delaying lighting rate signal Ls by two fields, the present invention can be applied. The same is true in the case where discharge delays by three fields or more with respect to video signal Sig.

As mentioned above, lighting rate Li of each field is calculated in advance. In accordance with this lighting rate Li, output current Io of DC-DC converter, which is equal to discharge current Id in sustain period T3, is output, and feed-forward control is performed so that voltage Vo becomes constant. Furthermore, when an unpredictable change, for example, the change of commercial power supply occurs, the change of output voltage Vo can be suppressed by feedback control.

Note here that in a highly precise PDP having an extremely large number of discharge cells, the PDP is divided into a plurality of scanning blocks and much electric power is supplied at the time of sustain discharge in each scanning block. When the plasma display device of the present invention is introduced into this highly precise PDP, electric power necessary for the sustain discharge can be supplied at all times without shortage. Thus, PDP capable of displaying clear images without unevenness in an image can be obtained.

The plasma display device of the present invention can provide a plasma display device capable of displaying an image with correct gradation values with output voltage kept constant even when a discharge current of a PDP is rapidly changed. Therefore, the plasma display device is useful as a large screen display device, and the like.

The invention claimed is:

1. A plasma display device for displaying an image, in a plasma display panel having a scanning electrode, a sustain electrode and a data electrode and provided with a plurality of discharge cells, by dividing one field period into a plurality of subfields each having an initialization period, a writing period and a sustain period and by performing or not performing a discharge in the plurality of discharge cells in the sustain period based on a video signal, the plasma display device comprising:

a sustain pulse voltage applying section for applying, to the scan electrode and the sustain electrode, a sustain pulse voltage for allowing the discharge in the plurality of discharge cells;

a lighting rate calculation section for calculating, from the video signal in advance for each subfield of the plurality of subfields, a lighting rate showing a rate of discharge in the plurality of discharge cells in the sustain period;

a power supply section for supplying the sustain pulse voltage applying section with electric power; and a control section for controlling the power supply section based on the calculated lighting rate so that the sustain pulse voltage becomes constant, wherein the control section obtains a first current control signal based on the calculated lighting rate and inputs the obtained first current control signal into the power supply section for keeping an output voltage of the power supply section constant by controlling an output current of the power supply section based on the obtained first current control signal, and wherein the control section further comprises a feedback control section for obtaining a second current control signal based on the output voltage of the power supply section and for inputting the obtained second current signal into the power supply section, and the control section keeps the output voltage of the power supply section constant by controlling the output current of the power supply section based on the first current control signal and the second current control signal.

2. The plasma display device of claim 1, further comprising a storage section in which the first current control signal that corresponds to the calculated lighting rate is stored in advance.

* * * * *